United States Patent [19]

Rossman

[11] 4,083,128

[45] Apr. 11, 1978

[54] ADJUSTABLE BOOT

[76] Inventor: Robert A. Rossman, 154 Riveredge Dr., Leola, Pa. 17540

[21] Appl. No.: 800,404

[22] Filed: May 25, 1977

[51] Int. Cl.[2] ..... A43B 3/26

[52] U.S. Cl. ..... 36/97

[58] Field of Search ..... 36/117, 97

[56] References Cited

U.S. PATENT DOCUMENTS

| | | | |
|---|---|---|---|
| 641,642 | 1/1900 | Gunn | 36/97 |
| 3,541,708 | 11/1970 | Rosen | 36/97 |
| 3,686,777 | 8/1972 | Rosen | 36/97 |
| 3,922,800 | 12/1975 | Miller et al. | 36/97 X |

*Primary Examiner*—Patrick D. Lawson
*Attorney, Agent, or Firm*—Martin Fruitman

[57] ABSTRACT

A size-adjustable ski boot and skate shoe which adjusts both the width and length of the front of the boot to accommodate various sizes of feet. A clam-shell construction of widthwise halves of the toe attached to quarter sections of the sole permits both length and width movement of both the sole and shell of the boot. When fasteners on the sole plate are loosened, a screw adjustment is used to move the sole plate with attached half-toe longitudinally and laterally to increase the boot size. An alternate system uses replaceable toe sections of varying sizes.

7 Claims, 2 Drawing Figures

ADJUSTABLE BOOT

BACKGROUND OF THE INVENTION

This invention relates generally to ski boots and skate shoes and more specifically to such footwear which is adjustable to a considerable degree in both length and width.

With the increased interest in skiing, particularly for young people, has come the economic problem of buying new ski boots as a youth grows. For a fast growing teenager, the problem can require new boots every season, or possibly even more frequently. While some adjustable boot designs exist, such as in U.S. Pat. No. 3,922,800, they are essentially intended to accommodate the foot to a particular size boot by making adjustments only great enough to accommodate minor variations due to individual foot shapes. Other designs, such as U.S. Pat. No. 3,686,777, have been proposed which adjust a shoe or boot in only one direction, such as width, but such designs are unsatisfactory for a growing foot which increases in both width and length.

SUMMARY OF THE INVENTION

The present invention permits adjustment to a full range of sizes in both width and length by use of the clam-shell construction. The inner portion of the boot forward of the arch is split into two half shells, each one attached to a section of the similarly split sole plate. The basic configuration of the toe section of the boot is therefore formed by two freely moveable clam-shell sections covered by the shell of the boot except for the most forward portion of the toe. The joint between the sections is formed by an overlapping strip rigidly attached to one half of the clam-shell and freely moving relative to the other half. The moveable sole plate sections are anchored to the sole of the boot by releasable fasteners which clamp the sole plates through slots long enough to furnish the full adjustment desired. Once loosened, the fasteners act as guides for movement of the sole plates within the limitations prescribed by the slots. The slots in at least one sole plate are angled slightly relative to the front to rear centerline of the boot, thus permitting expansion of the boot width. Controlled motion is imparted to the sole plates by a captured screw thread actuator, which causes the sole plates to move relative to the fixed sole.

An alternative embodiment consists of several replaceable toe sections, each with different lengths and widths. These sections are anchored by a series of conventional fasteners, but they are interchangeable as the foot size increases.

For both embodiments, weather seals between the sole plates and soles and between the toe covers and the balance of the boot are accomplished by the use of such pliable materials as foam rubber, which can both seal out the elements and be compressed to make some accommodation to movement of the sections of the boot. Moreover, the toe cover sections permit firm tightening of the boot against them while shielding the wearer's foot from undue pressure.

DETAILED DESCRIPTION OF THE INVENTION

Figure 1:
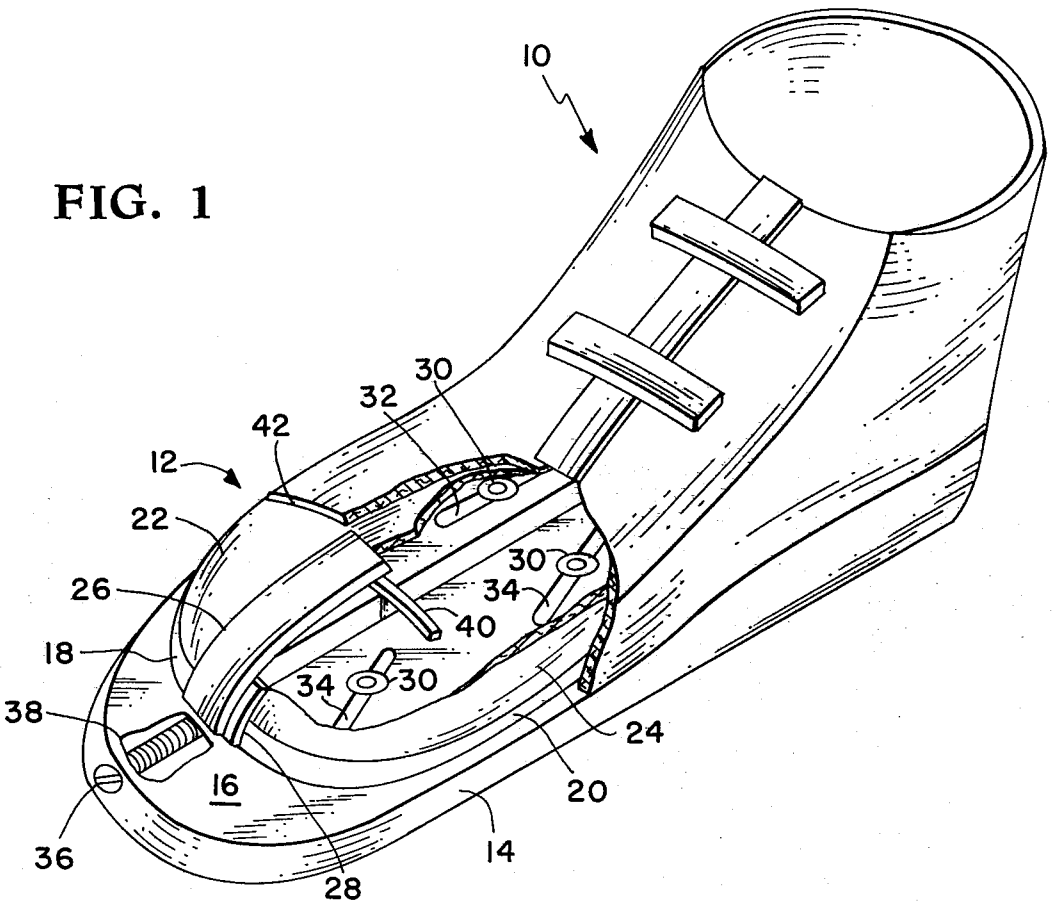
FIG. 1 is a cutaway view of the preferred embodiment of the invention which uses moveable half toe sections for adjustability of size.

The preferred embodiment is shown in FIG. 1 where boot 10 is shown with adjustable front section 12. The entire boot structure is built upon fixed platform sole 14, which can be either an independent plate, as would be used in a ski boot, or, as used in a skate, a portion of the skate structure. Attached to the top surface 16 of fixed platform sole 14 are two adjustable half sole plates 18 and 20. Toe cap 22 is attached to half sole plate 18 and forms approximately one half of the front toe covering of boot 10. Toe cap 24, shown partially cut away, is attached to half sole plate 20 and covers essentially the other half of the toe structure. Overlap strip 26 attached to only toe cap 22 covers the junction between toe cap 22 and toe cap 24 and permits toe cap 24 to move freely relative to toe cap 22, without exposing a crack between them. Weather seal 28, attached to toe cap 24, is made of a pliable material, such as foam, and is compressed slightly to assure no space of any significance is open under overlap strip 26.

Half sole plates 18 and 20 are attached to fixed platform sole 14 by means of fasteners 30, which preferably have square shanks passing through square holes in fixed platform sole 14 to prevent turning. Fasteners 30 have flat heads and threaded axial holes into which machine screws assessible from below fixed platform sole 14 may be threaded for locking half sole plates 18 and 20 in position.

Fasteners 30 pass through longitudinal slots 32 in half sole plate 18 and angled slots 34 in half sole plate 20. The half sole plates thus have freedom of motion within the constraints of slots 32 and 34. As shown, longitudinal slots 32 permit half sole plate 18 to slide parallel to the boot axis and angled slots 34 permit half sole plate 20 to move at a slight angle to the axis of the boot. Both the length and the width of the front portion 12 of the boot can thus be adjusted.

Although this adjustment could be accomplished by simply loosening the half sole plates and gripping the toe caps to move them to a suitable position, a means of automatic adjustment is shown in FIG. 1. Threaded rod 36 is there shown embedded in fixed platform sole 14 at cutaway 38. Threaded rod 36, also captured at its far end within fixed platform sole 14, is threaded through actuator 40 which therefore moves longitudinally as threaded rod 38 is turned. The forward or backward movement of actuator 40, in turn, pushes half sole plates 18 and 20 in the same direction, thus adjusting the boot length and width.

Weather seal 42 at the junction of toe section 12 and the rear section of the boot is pressed against the toe when the boot is tightened, and thus assures protection from leakage.

Figure 2:
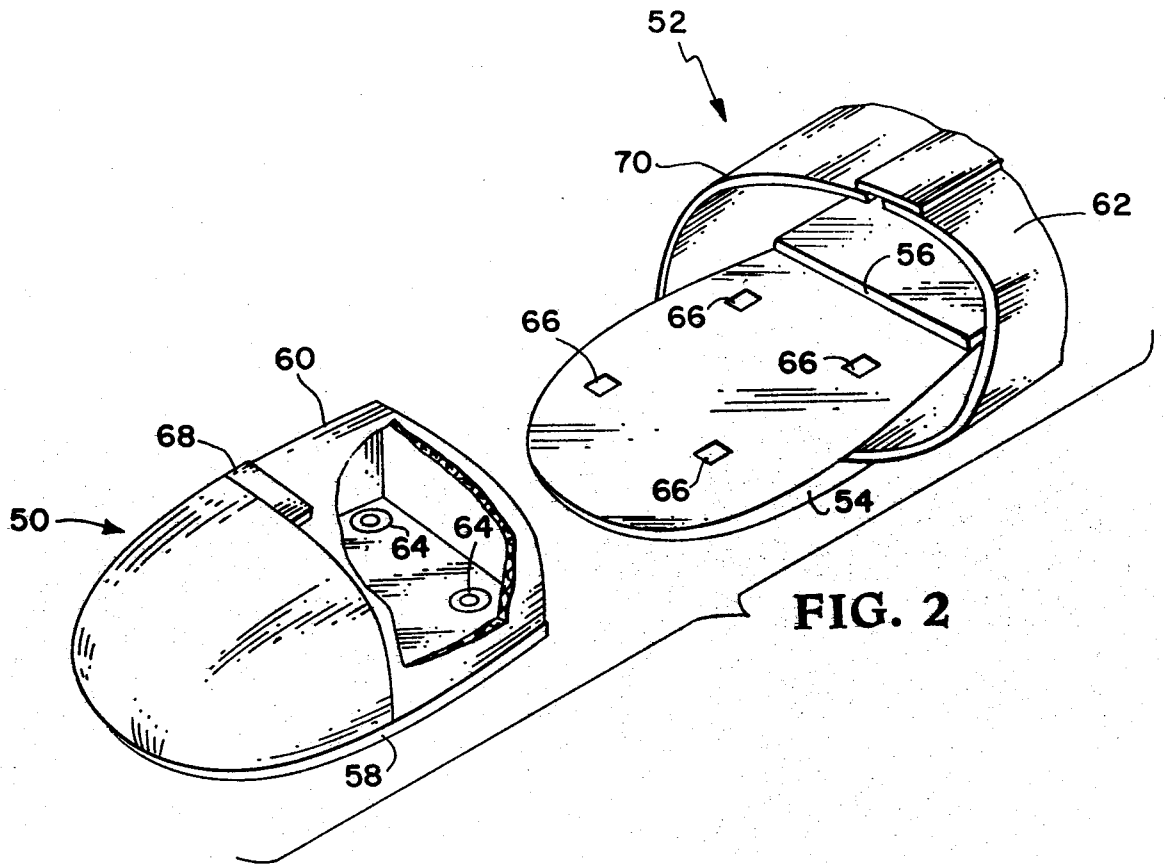
FIG. 2 is an exploded cutaway view of the toe section of another embodiment of the invention which uses interchangeable toe sections.

FIG. 2 shows an alternative embodiment of an adjustable boot in which interchangeable toe sections 50 are replaceable into boot 52 to accommodate longer or wider feet. In this embodiment, platform sole 54 is constructed with a step 56 to permit toe plate 58 to fit flush and furnish an even surface upon which to place an inner sole pad (not shown). When toe plate 58 is placed upon platform sole 54, toe cover 60 fits well within boot upper 62 and fasteners 64 align with through holes 66 in platform sole 54. Fasteners 64 are captured within toe plate 58 and contain a threaded axial hole to permit the use of machine screws for tightening them from the underside of platform sole 54. Weather seal 68 is positioned upon toe cover 60 to align with leading edge 70 of boot upper 62 so that leakage is prevented when the boot is tightened by the wearer.

Should an inner liner be required, as for many ski boots, the adjustment for different sizes is accomplished by a simple overlapping flap arrangement which permits sliding of the flaps to increase or decrease the size. For the removable toe embodiment, a permanently installed toe liner is placed in each removable section in order to mate with the liner permanently installed in the boot.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For instance, preset rivets may be used in place of threaded fasteners 30 in FIG. 1. Such rivets are tightened only to the point of creating friction between half sole plates 18 and 20 and platform sole 14. The locking action is accomplished by actuator 40, itself locked in place by threaded rod 36.

What is claimed as new and desired to be secured by Letters Patent of the United States is:

1. A width and length adjustable boot for use with skis and skates comprising:

a fixed platform sole, attachable to the equipment used and permanently attached to and protruding forward from the boot at approximately the front edge of the arch;

a sole plate of length from the front edge of the boot to approximately the front of the arch of the boot, split longitudinally into a first half sole plate and a second half sole plate, the first and second halves being moveable relative to each other and each independently slideably attached to said fixed platform sole, at least one of said halves being moveable both laterally and longitudinally relative to the fixed platform sole;

a toe cover split longitudinally forming a first toe cover section attached to the first half sole plate and a second toe cover section attached to the second half sole plate;

weather sealing means sealing the junction between the first and second toe cover sections and between the toe cover sections and the remaining portion of the boot; and fastening means fixing the first and second half sole plates in particular positions on the fixed platform sole to prevent motion while the boot is in use.

2. A width and length adjustable boot for use with skis and skates as in claim 1 wherein the fastening means are loosenable captured fasteners passing through elongated slots in the first and second half sole plates.

3. A width and length adjustable boot for use with skis and skates as in claim 1 wherein the first half sole plate and the second half sole plate are moved and adjusted simultaneously by means of an actuator attached to the fixed platform sole.

4. A width and length adjustable boot for use with skis and skates as in claim 3 wherein the fastening means are preset and permit motion by the actuator.

5. A width and length adjustable boot for use with skis and skates as in claim 1 wherein the locking means are at least two captured threaded fasteners for each half sole plate accessible for tightening from the underside of the fixed platform sole.

6. A width and length adjustable boot for use with skis and skates comprising:

a full length fixed platform sole attachable to the equipment used and permanently attached to and protruding forward from a boot the upper portion of which is removed forward of approximately the front edge of the arch;

a replaceable toe section attachable to the portion of the fixed platform sole, mating with the balance of the boot and overlapping at least a portion of the entire cross-section of the boot at the point where the toe section meets the boot;

locking means fixing the replaceable toe section to the fixed platform sole; and weather sealing means sealing the junction between the replaceable toe section and the remaining portion of the boot.

7. A width and length adjustable boot for use with skis and skates as in claim 6 wherein the locking means is at least two captured fasteners accessible for tightening from the underside of the fixed platform sole.

* * * * *